US007314501B2

(12) United States Patent
Fayard

(10) Patent No.: US 7,314,501 B2
(45) Date of Patent: Jan. 1, 2008

(54) METHODS AND DEVICE FOR FILTRATION OF EXHAUST GASES FOR A DIESEL ENGINE WITH A FILTRATION SURFACE WHICH IS VARIABLE BY MEANS OF CONTROLLED OBSTRUCTION

(76) Inventor: Jean-Claude Fayard, 44 ter rue Professeur Florence, 69003 Lyons (FR)

( * ) Notice: Subject to any disclaimer, the term of this patent is extended or adjusted under 35 U.S.C. 154(b) by 403 days.

(21) Appl. No.: 10/516,369

(22) PCT Filed: Jun. 3, 2003

(86) PCT No.: PCT/FR03/50004

§ 371 (c)(1),
(2), (4) Date: Dec. 15, 2004

(87) PCT Pub. No.: WO03/102389

PCT Pub. Date: Dec. 11, 2003

(65) Prior Publication Data

US 2005/0257518 A1 Nov. 24, 2005

(30) Foreign Application Priority Data

Jun. 4, 2002 (FR) ..... 02 06835

(51) Int. Cl.
*B01D 46/00* (2006.01)
*F01N 3/021* (2006.01)
*F01N 3/10* (2006.01)

(52) U.S. Cl. ..... 95/14; 95/278; 55/282.2; 55/282.3; 55/283; 55/385.3; 55/417; 55/418; 55/419; 55/484; 55/523; 55/524; 55/DIG. 10; 55/DIG. 30; 96/420; 60/274; 60/278; 60/294; 60/297; 60/299; 60/311

(58) Field of Classification Search ..... 95/1, 95/14, 293, 295; 55/282.2, 282.3, 283, 385.3, 55/410, 417, 418, 419, 482, 484, 527, 584, 55/DIG. 10, DIG. 30; 60/273, 274, 278, 60/294, 295, 297, 299, 303, 311; 96/420
See application file for complete search history.

(56) References Cited

U.S. PATENT DOCUMENTS 4,840,028 A * 6/1989 Kusuda et al. ..... 60/303

(Continued)

FOREIGN PATENT DOCUMENTS

EP 0 283 240 9/1988

(Continued)

*Primary Examiner*—Jason M. Greene
(74) *Attorney, Agent, or Firm*—James C. Lydon

(57) ABSTRACT

A method in which all or some of the particles contained in the exhaust gases of a diesel engine are retained on particle filters and burnt due to the action of a combustion catalyst. At least a part of the particle filters are obstructed when the temperature θg of the exhaust gases for filtration is equal to or less than a threshold temperature θs, so as to limit or avoid cooling of the obstructed part of the particle filters and to maintain the same at a temperature θo greater than or equal to θs up until the time when θg becomes greater than θs again and thus permit accelerated regeneration of the obstructed part of the particle filters. Also disclosed is an exhaust gas filtration device which permits the carrying out of the filtration method with continuous and regular regeneration of the particle filters.

16 Claims, 5 Drawing Sheets

U.S. PATENT DOCUMENTS

| | | | | | |
|---|---|---|---|---|---|
| 4,945,722 | A | * | 8/1990 | Goerlich | 60/295 |
| 5,293,742 | A | | 3/1994 | Gillingham et al. | 60/288 |
| 5,426,936 | A | * | 6/1995 | Levendis et al. | 60/278 |
| 5,454,845 | A | | 10/1995 | Anahara et al. | 55/267 |
| 5,519,993 | A | | 5/1996 | Rao et al. | 60/288 |
| 6,090,172 | A | * | 7/2000 | Dementhon et al. | 55/282.3 |
| 6,120,583 | A | * | 9/2000 | Saito et al. | 95/278 |
| 6,223,926 | B1 | | 5/2001 | Craven et al. | 220/484 |
| 6,233,926 | B1 | * | 5/2001 | Bailey et al. | 60/295 |
| 6,572,682 | B2 | * | 6/2003 | Peter et al. | 95/278 |

FOREIGN PATENT DOCUMENTS

| | | | |
|---|---|---|---|
| EP | 0 525 566 | | 2/1993 |
| JP | 56-092318 | | 7/1981 |
| JP | 09-222009 | | 8/1997 |
| JP | 9-222009 | * | 8/1997 |

* cited by examiner

METHODS AND DEVICE FOR FILTRATION OF EXHAUST GASES FOR A DIESEL ENGINE WITH A FILTRATION SURFACE WHICH IS VARIABLE BY MEANS OF CONTROLLED OBSTRUCTION

The present invention relates in general to the field of particulate filters and, more particularly, to a device for filtration of exhaust gases for diesel engines.

More particularly, the present invention relates to an exhaust gas filtration device for diesel engines further comprising a variable capacity filtration means for said gases, in which a catalysis means is disposed, associated or not with post-injection of diesel and with an exhaust gas recirculation system.

The reduction of pollutant emissions generated by combustion engines and, in particular, diesel engines is the objective set by the authorities. For this purpose, the establishment of ever more stringent standards obliges the automobile manufacturers to develop engines with increasingly reduced pollutant emissions, in order to limit the release of unburnt particles. Since modification of engine combustion is no longer sufficient to reach these low levels, the additional use of exhaust gas filtration devices will be indispensable to retain these particles and to meet the standards.

Thus, in order to reduce the emission of unburnt pollutant gases and of solid particles, automobile manufacturers have developed and have generalized the use of catalytic converters or catalysts, generally consisting of a stainless steel casing, a thermal insulation, and a honeycomb support impregnated with precious metals such as platinum or rhodium.

These catalytic converters henceforth further comprise a particulate filter that retains the carbon particles, constituting the unburnt particles emitted by the engine. However, a further difficulty has arisen in the use of these filters, which consists in finding ways to ensure that these carbon particles trapped on the filter can be burnt or oxidized as they are deposited, in order to prevent clogging of the filter.

All particulate filter techniques for diesel engines, used today or under development, are all faced with the major problem of the incomplete combustion of the particles retained on the filter medium. In fact, under urban use conditions, the temperature reached by the exhaust gases is insufficient to cause this combustion and to limit the ensuing clogging of the filter.

Without chemical assistance, the carbon particles produced by diesel combustion only begin to oxidize significantly above 500° C., and since these temperatures are never reached under urban driving conditions, on bus engines, reliance on a chemical method to lower this oxidation temperature has become unavoidable.

The absence of chemical assistance gives rise to clogging of the filter which, besides the fact that it causes a pressure drop in the engine and hence deteriorated operation of same, causes violent reactions associated with the instantaneous combustion of these carbon particles in excessive concentration in the filter, when engine malfunctioning causes the violent initiation of this combustion. The rapid combustion of a large mass of particles thereby generates a temperature above 1000° C. and generally leads to destruction of the filter by thermal shock, the temperatures obtained being too high locally.

Several systems are already in use to achieve the continuous oxidation of these particles.

Thus, certain systems propose the installation of a catalytic oxidation means upstream of the particulate filter, permitting the conversion of nitric oxide NO, present in the exhaust gas, to nitrogen dioxide $NO_2$ above 250° C. This technique, called "Continuous Regenerating Trap" (CRT), combines the effects of the particulate filter with the NO oxidation catalyst.

This means consists of a catalytic support on which the catalyst is fixed, the catalyst generally being a precious metal such as platinum or rhodium. The $NO_2$ produced by the action of said catalyst has the property of oxidizing the carbon particles above 250° C. However, the satisfactory operation of the filter depends on the average temperature reached and the ratio of particles emitted to the $NO_2$ formed. To ensure that the filters operate satisfactorily, this CRT system requires uniform regeneration, which limits the pressure drop across the filter while eliminating the risk of uncontrolled and exothermic regeneration.

This condition is only achieved if the exhaust gases or the combustion chamber are at a temperature above 250° C. during at least 30% of the vehicle running time.

If not, violent reactions are developed, associated with the excessive concentration of carbonaceous particles clogging the filter. These reactions consist of the excessively rapid combustion of a large mass of particles, generally leading to the destruction of the filter by thermal shock, because very high temperatures are reached locally.

A similar means is available constituting a variant of the above, in which the catalyst is directly deposited on the particulate filter. However, only some materials suitable for the particulate filter are able to fix metal catalysts. This is the case of cordierite in particular. In fact, materials of this type are known to be particularly sensitive to the increase in temperature and to thermal shocks. It accordingly appears that the sudden increases in temperature which can occur in a clogged particulate filter can cause irreversible damage to the filter. This makes it necessary to replace the particulate filter and in general the exhaust device, thereby incurring an absolutely prohibitive cost.

Other regeneration techniques make use of organometallic additives added to the diesel, such as cerium, iron, strontium, calcium, and others, in order to coat the carbon particles formed with the metal oxide of the catalyst and thereby to oxidize the carbon at lower temperature.

These techniques are suitable for obtaining a similar effect to the one obtained with $NO_2$, by catalyzing the combustion of carbonaceous materials at temperatures close to 300 or 350° C.

A first drawback of these techniques is the prohibitive cost of the additives used, compounded by the fact that a supplementary additive device must be provided.

A further drawback of these techniques is that they display an even greater tendency to clogging of the filter and hence to the attendant reactions, because if the temperatures reached in operation are not sufficiently high, the additives present in the carbonaceous materials contribute to an even faster clogging of the filter medium.

Other techniques have involved testing devices based on supplementary heating means such as burners, electric resistors and others. These supplementary heating means are only employed when the cartridge displays incipient clogging, causing an increase in the pressure drop. Such a regeneration device is put into practice with the engine running, that is to say in the presence of a high exhaust gas flow. Hence such a device requires high heating capacity to heat the exhaust gases and the mass of the filter cartridge to the right temperature simultaneously.

In such a technical context, one object of the present invention is to provide a method for filtration of exhaust gases (in particular of diesel engines) that remedies the drawbacks of the various existing techniques, by optimizing the filtration of the exhaust gases, for example of diesel engines, particularly in terms of regeneration of the filtration means, in order to provide a satisfactory solution to the problem of clogging of the filtration means by carbon particles.

A further object of the invention is to provide a method for filtration of exhaust gases incorporating uniform, efficient and continuous regeneration, thereby avoiding any risk of particle accumulation in the filtration means and hence of uncontrolled regeneration.

A further object of the invention is to provide a method for filtration of exhaust gases in which the incorporated regeneration does not cause any significant overconsumption of fuel and, in general, does not incur any extra financial cost to the user.

A further object of the invention is to provide a method for filtration of exhaust gases in which the incorporated regeneration does not deteriorate engine performance, particularly by pressure drops, caused by the backpressure exerted by the exhaust gases on the engine, due to the clogging of the filtration device.

A final object of the invention is to provide a filtration device for putting into practice the filtration method according to the invention.

These objectives, among others, are achieved by the present invention, which primarily relates to a method for filtration of exhaust gases, e.g. those emitted by a diesel engine. In this method for filtration of exhaust gases, all or part of the particles present in said exhaust gases are retained on filtration means and are burnt by the action of a combustion catalyst. This method essentially consists in obstructing at least a portion of the filtration means as soon as the temperature $\theta g$ of the exhaust gases to be filtered becomes equal to or lower than a threshold temperature $\theta s$, so as to limit, indeed to avoid, the cooling of the obstructed portion and to maintain same at a temperature $\theta o$ that is equal to or greater than $\theta s$, up to the time when $\theta g$ again becomes greater than $\theta s$, and thereby to permit accelerated regeneration of this obstructed portion of the filtration means, because the temperature conditions are better than those that would obtain if this portion of the filtration means had not been obstructed.

Hence according to the invention, the exhaust gases are filtered on a filtration means consisting for example of at least two cartridges disposed in one casing, one of the two cartridges being short-circuited when the engine is running without load or is idling, in order to maintain, in the isolated cartridge without flow, a sufficient temperature to cause a significant continuous regeneration rate, when the engine is again running with hot exhaust gases. Each cartridge is preferably short-circuited in turn so that it is continuously regenerated.

In the filtration units thus isolated and maintained at high temperature in the absence of cold gas, a regeneration process will continue to take place slowly thanks to the very slight flow rate that is maintained, but above all these filtration units will be maintained at an optimal temperature until the engine is again running and the hot exhaust gases are again admitted. The regeneration process in these isolated cartridges can then take place continuously, eliminating any risk of clogging.

Preferably, the various portions of the filtration means are successively each subjected to the obstruction/regeneration sequence for each variation of $\theta g$ between a value v1 that is equal to or greater than $\theta s$, a value v2 equal to or lower than $\theta s$, and again a value v3 equal to or greater than $\theta s$, $v1 = \text{or} \neq v3$, so as to permit a uniform and continuous regeneration of the filtration means.

According to a noteworthy feature of the invention, the obstruction of a portion of the filtration means consists in preventing the flow of the exhaust gases in at least 30%, preferably in at least 50%, and even more preferably in 50 to 75% of the filtration means, this percentage being expressed as a percentage by volume.

Preferably, $\theta s = 250°$ C. or 300° C.

Advantageously, the exhaust gases are produced by a supercharged diesel engine and the datum parameters, that is the temperature $\theta g$ of the exhaust gases and the threshold temperature $\theta s$, are given indirectly by the boost pressure and/or the engine speed and/or the backpressure upstream of the filtration means, the threshold boost pressure being preferably equal to 2.5% of the maximum boost pressure of the engine.

According to a preferred embodiment, the filtration means consist of at least two—preferably at least three—filter cartridges, each equipped with an obstructor, two of the three cartridges that the filtration means preferably comprise constituting the obstructed portion of the filtration means when $\theta g \leqq \theta s$.

According to another of these aspects, an object of the invention is a device for filtration of exhaust gases comprising at least one catalysis means, means for filtration of said exhaust gases, disposed in a reaction chamber in the path of the exhaust gas stream produced by an engine, said device being characterized in that the filtration means consists of at least two assemblies each comprising a catalyst support adjacent a filter cartridge equipped with a flow obstruction means.

Advantageously, the device comprises a means for recirculating the exhaust gases at the engine intake the operation of which is associated with the cutoff of the flow in one or a plurality of the cartridges when the engine is not accelerated, so that the increase in backpressure generated automatically opens a valve that permits this recirculation of the exhaust gases.

According to a preferred feature of the device according to the invention, each of the filter cartridges has a flow obstruction means, disposed upstream or downstream, controlled by an electronic computer which takes account of all the engine operating conditions, in order to isolate at least one cartridge each time the accelerator position is at zero (not accelerated).

In an advantageous embodiment of the device according to the invention, the filtration means consists of at least three cartridges with a flow obstruction means on each of them, controlled by an electronic computer which takes account of all the engine operating conditions, in order to isolate, in turn, at least two cartridges when the engine is not accelerated, and to isolate the cartridge that filtered the gases in the non-accelerated position, each time the engine is accelerated.

Advantageously, the flow obstruction means disposed on each filter cartridge comprise a small calibrated orifice to maintain a very low flow rate.

According to an advantageous variant, the device comprises a system for post-injection of diesel into the exhaust gases, via an atomizer, preferably upstream of the filtration device and the catalysts, controlled by an electronic computer which takes account of all the engine operating conditions, this diesel post-injection system possibly being associated with an exhaust gas recirculation system.

In this variant, it may be advisable for the diesel injected to contain an organometallic combustion catalyst, supplied or not from a specific tank.

Finally, within the scope of the invention, the device can make use of known organometallic additives which are injected by the post-injection system instead of the diesel.

In the preferred embodiment, the filtration means consists of an assembly of at least two filtration units each equipped with an obstruction means controlled by a computer which takes account of the engine operating conditions.

If the device according to the invention comprises more than two filtration units, each of said filtration units will comprise an obstruction means in order to short-circuit them in turn.

The obstruction means for each of the cartridges used will be placed downstream of the filtration unit.

According to a variant of the invention, the obstruction means may also be incorporated upstream of the filtration unit and the associated catalyst.

According to a noteworthy feature of the invention, said filtration units will each incorporate a catalyst disk upstream, preferably on metal support.

The catalyst is a conventional platinum-based oxidation catalyst, in order to achieve complete oxidation of the hydrocarbons and of the CO.

According to a further variant of the invention, the filtration device comprises a system permitting the recycling of the exhaust gases when the filtration capacity is reduced, thereby exploiting the increase in backpressure caused by this restriction to send a portion of the unfiltered exhaust gases into the intake line, through a nonreturn valve.

According to a variant of the invention, the filtration device comprises more than three cartridges and a sufficient number so that, for full-load running conditions, one of the cartridges is isolated, this cartridge being reserved for the filtration of the gases at partial load or at idling. The aim is to maintain the filter medium and the catalyst of each of the cartridges used at full load, at high temperature. The cartridges used at idling will be switched with one of the others when incipient clogging is detected.

BRIEF DESCRIPTION OF THE DRAWINGS

The present invention will be better understood from a reading of the description that follows, with reference to the drawings which, in a non-limiting manner, show an embodiment of the filtration device according to the invention and in which.

Figure 1:
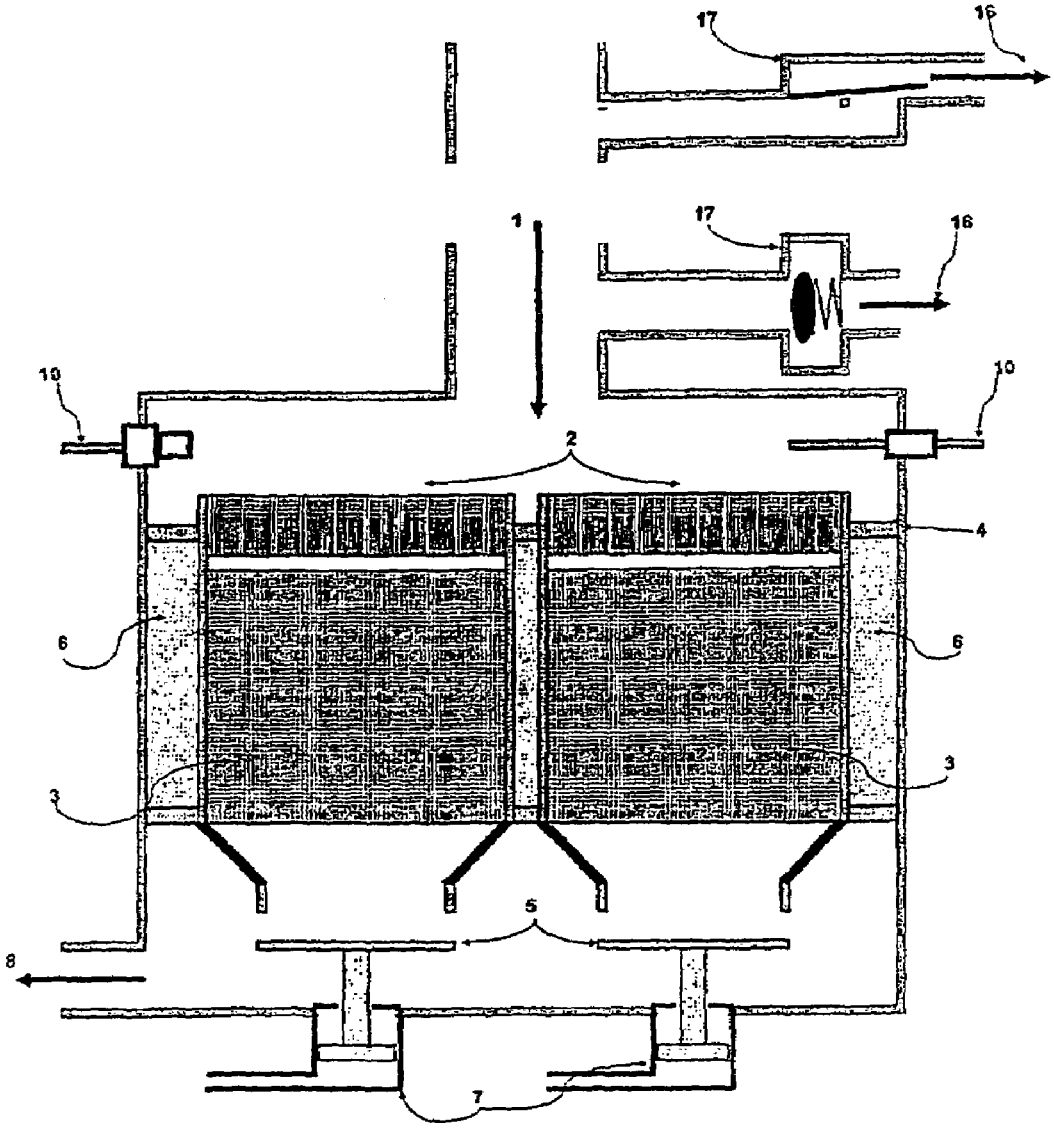
FIG. 1, according to a preferred embodiment of the invention, shows a general view of the system comprising the filtration device with two cartridges, each having an oxidation catalyst on metal support upstream and, downstream, a valve actuated to completely obstruct, when necessary, the flow of the gases to be filtered. The filtration device is associated with an exhaust gas recycle system with its nonreturn valve.

The system suitable for putting into practice the filtration device according to the invention is shown in detail in FIG. 1, according to a preferred embodiment. In this system, various mechanical components of the vehicle, which do or do not form part of the filtration device, and which contribute to the regeneration, collaborate.

Thus the exhaust gases leaving the engine are introduced into the device via the nozzle 1, and are then sent to each catalyst disk on metal support 2, for filtration on the two filtration cartridges 3, these cartridges preferably being made of silicon carbide, but possibly also consisting of a filter medium of cordierite or other ceramics. They are disposed inside a chamber 4 and isolated from it via an insulation 6, to avoid being cooled by the ambient air.

Valves 5 are disposed at the outlet of these filter cartridges in order to completely isolate each cartridge and totally obstruct the exit channel. These valves are actuated by air cylinders 7, and the exhaust gases are then sent to the outlet 8.

The device will operate as follows: when the position of the accelerator returns to the zero (non-accelerated) position, a position detector not described sends the data to a computer, which alternately actuates each cylinder to obstruct one of the two cartridges completely and to use only a single one for these particular operating conditions. The filter medium of the cartridge obstructed by the valve will thereby remain at the high temperature that it had reached during the last acceleration, the valve only being disabled to restore it into operation when the engine is again accelerated, hence again at high exhaust gas temperatures. To enable each one of them to be regenerated satisfactorily, the same cartridge will be obstructed during an interval of five to ten minutes, and another alternative will be to measure the backpressure at idling on the cartridge used and to actuate the switch to the other cartridge when the preset level is reached.

This FIG. 1 also shows the possibility of associating an exhaust gas recycle system which is automatically actuated, via the line 16, in the direction of the intake manifold 20, when one of the valves 5 is obstructed, and when the resulting increase in backpressure generates a flow through the valve 17, these conditions corresponding to a zero accelerator position hence a low exhaust gas temperature.

The recycling serves to reduce the flow of filtered exhaust gas through the cartridge that remains active in these conditions, and hence to reduce its cooling. Similarly, the introduction of hot exhaust gases mixed with the air entering the manifold at 20, after the turbocompressor 18, through the engine 21, will cause a substantial increase in the temperature of the exhaust gases discharged through the nozzle 22, possibly raising it during idling from the usual 90 to 100° C. to more than 160° C. at the inlet of the device 23.

The valve 17 is a nonreturn valve with a large cross section or, even better, of the leaf valve type permitting a flow with a few millibar of overpressure. The dimensioning of the valve 17 and of the line leading to the intake manifold 20 is such that this assembly permits recycling of the exhaust gases amounting to 30 to 60% of the flow under idling conditions.

As soon as the engine is accelerated, the pressure in the intake manifold exceeds the backpressure at the filter inlet, obstructing the valve 17 and automatically interrupting the exhaust gas recycle stream.

Figure 2:
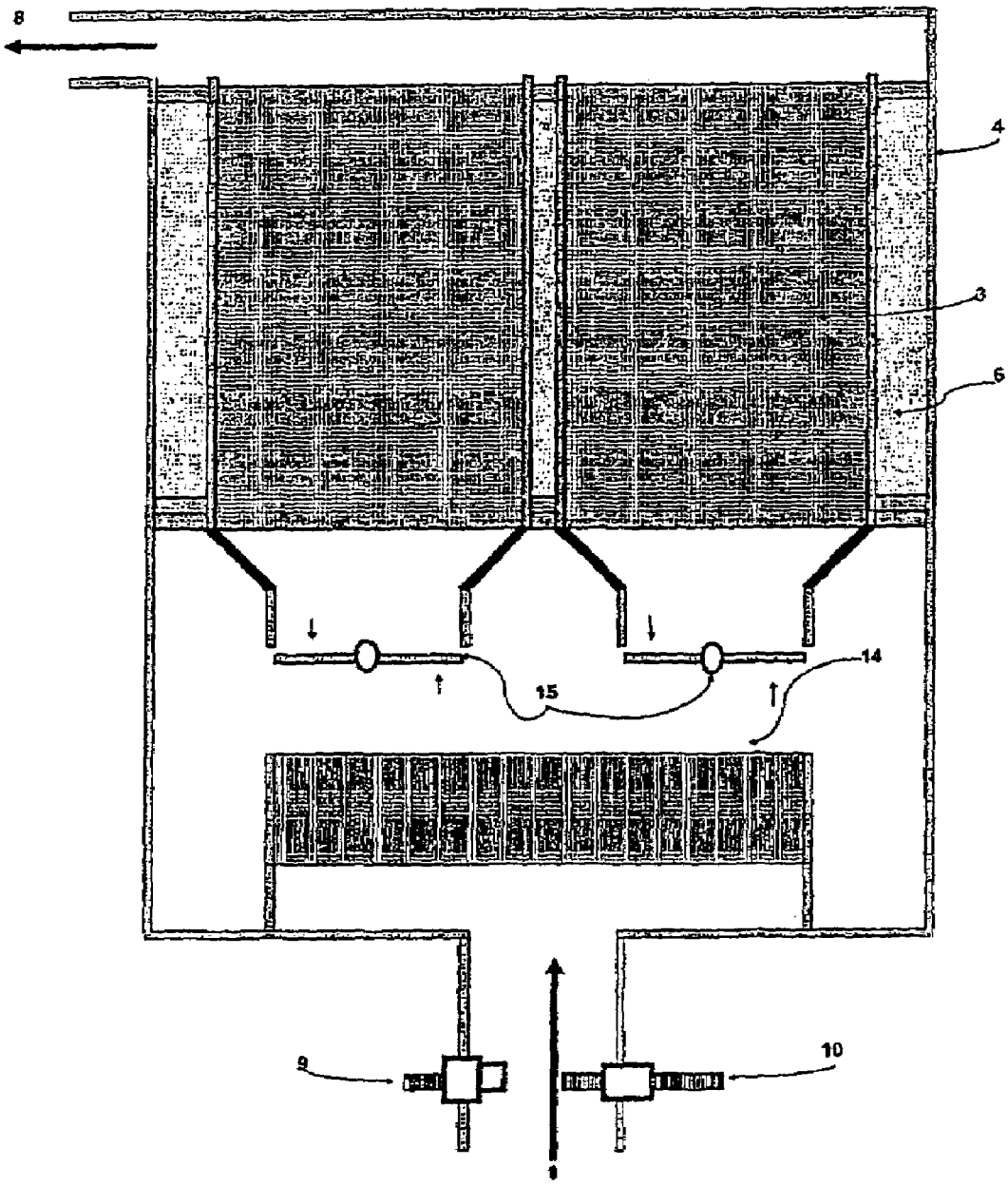
FIG. 2 shows a general view of the filtration device comprising a catalyst independent of the filtration units associated with an obstruction system placed upstream.

In FIG. 2, the variant of the device shown is different in the use of a common catalyst 14 for the two cartridges 3 and the use of butterflies 15, disposed upstream of the cartridges to obstruct the filters instead of the valves 5, used in the preferred embodiment of FIG. 1.

Figure 3:
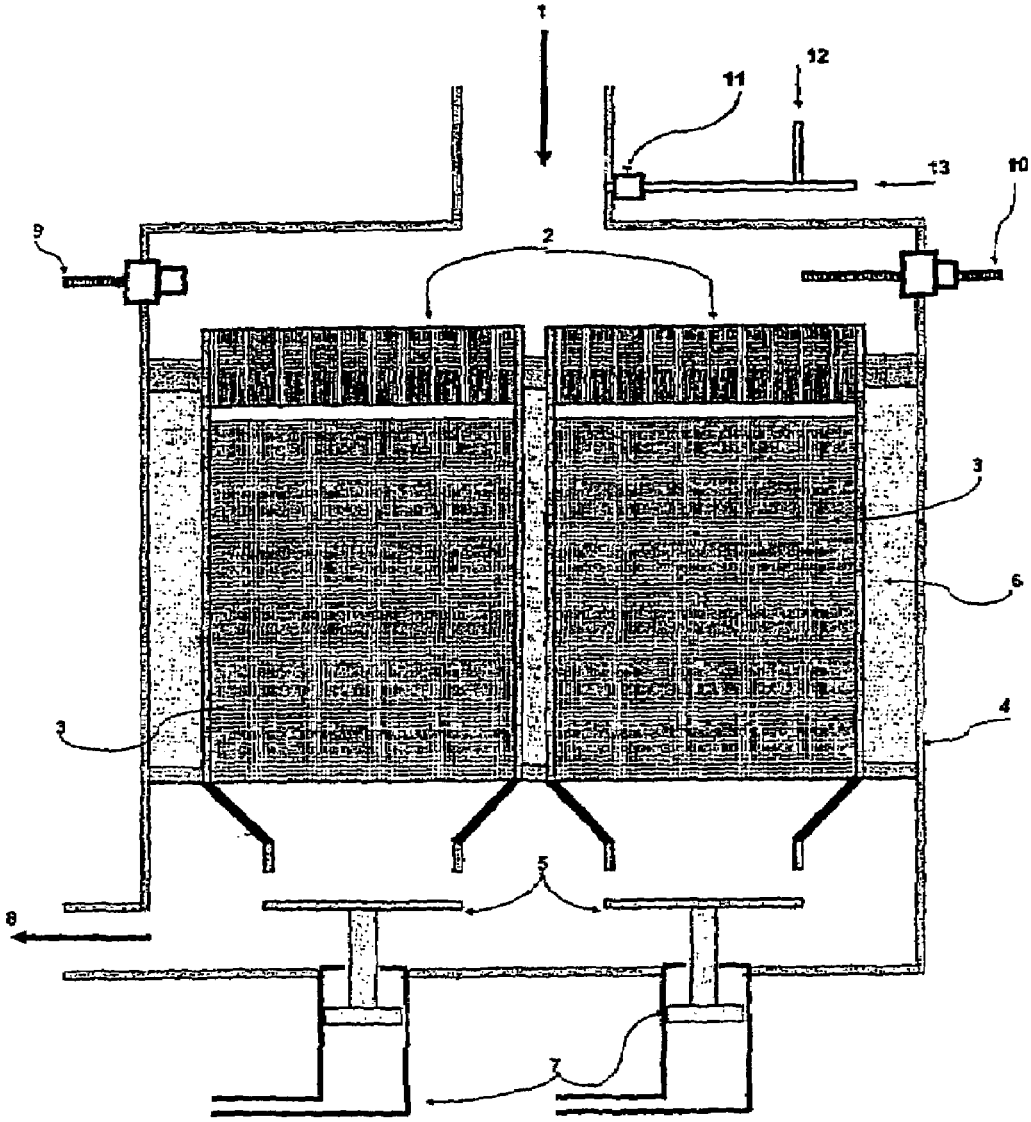
FIG. 3 shows a general view of the filtration device which incorporates a diesel injection system.
Figure 5:
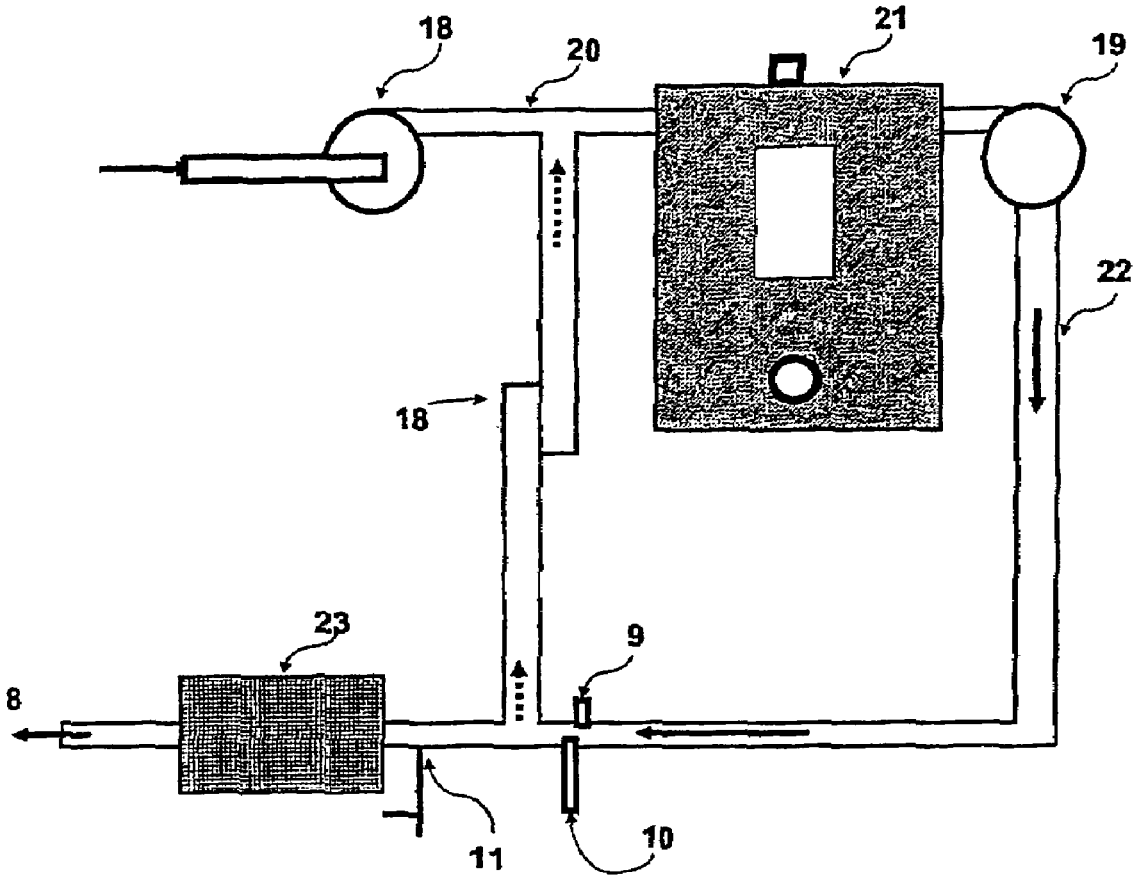
FIG. 5 shows a general view of the filtration device with all the variants incorporated in the engine environment.

FIGS. 3 and 5 show the possibility of further having a diesel injection system upstream of the filtration device, actuated from the data acquired at the pressure sensors 9 and temperature sensors 10, disposed upstream of the filters, the computer adjusting the best strategy to keep each of the filters perfectly clean, even going as far as to cause supplementary diesel injection through the atomizer 11, supplied with air 12 and diesel 13. These injections are aimed at increasing the exhaust gas temperature when the engine is running at full load, in order to heat the filter medium to a higher temperature to accelerate the regeneration rate. These injections are only employed if incipient clogging of the filter is detected.

Figure 4:
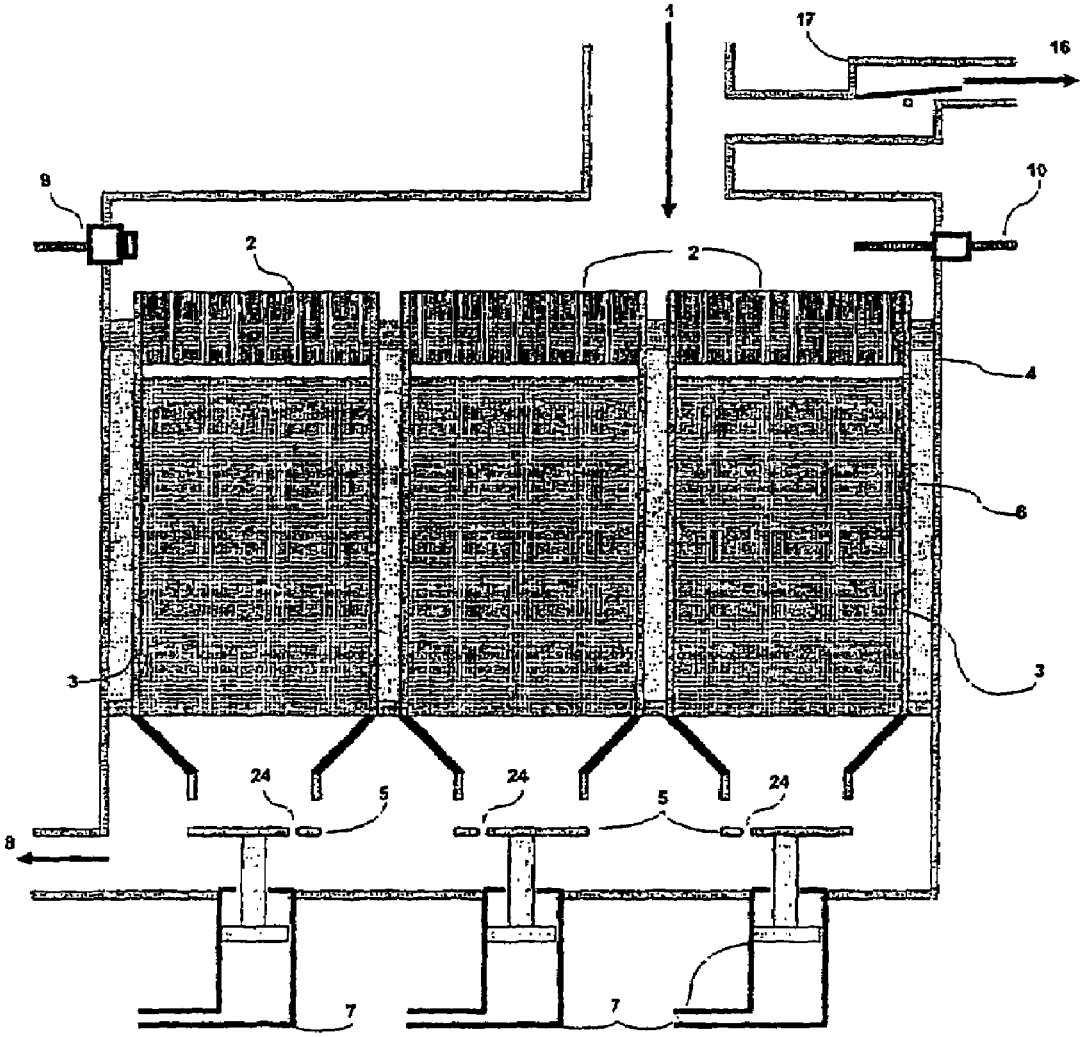
FIG. 4 shows a variant of the filtration device incorporating three filtration cartridges.

FIG. 4 is a variant that uses three filter cartridges instead of two, and which permits better maintenance of the temperature in the filter medium.

In fact, with a device comprising three cartridges, it is possible to introduce a further variant in the isolation control of each of the cartridges, by using the backpressure and temperature data sent to the computer by the sensors according to a strategy described below.

For example, when the accelerator position returns to zero, two of the three cartridges are obstructed and the gas stream only passes through one cartridge in this position. The flow is only restored to these two cartridges progressively upon the next acceleration, and the backpressure data is taken into account to determine the ideal moment for restoring these cartridges to the circuit. For example, the computer will trigger the opening of the valve of a first cartridge as soon as a backpressure level of 100 mbar is detected, and the valve of the second cartridge is only opened if this backpressure level of 100 mbar persists.

Depending on the type of engine used, this backpressure level may be different from the value of 100 mbar that we have used as an example.

A variant of the strategy described above may be to use the temperature data in addition, for example when the temperature θs falls below 250° C. or 300° C., to decide to close one or a plurality of cartridges at a given backpressure level and independently of the other service conditions.

As we have seen, the objective of each of the valves associated with each cartridge is to be able to isolate them to preserve the high temperature level obtained during the previous full engine load and to prevent them from cooling upon the following partial or idling load, since this high temperature favors the combustion reactions and there is a major advantage in keeping the valve closed with a low exhaust gas flow to maintain these combustion reactions, which are highly exothermic and which even tend to raise these temperatures. This operation will be feasible by using valves with a small calibrated orifice 24, of less than one to a few millimeters, the orifice diameter depending on the engine displacement to allow the necessary flow to pass through.

It should be noted that the possibility of maintaining the filter medium at higher temperature on at least one of the two cartridges will serve to obtain a far higher nitrogen oxide reduction efficiency on said cartridge thanks to the reaction of the nitrogen oxides with the carbon that takes place at higher temperature. With this device, nitrogen oxide reductions of over 30% have been recorded in accordance with the official measurement procedures.

Similarly, a higher hydrocarbon reduction efficiency on the official pollution cycles has been observed thanks to the maintenance of at least one of the catalyst disks at high temperature for the devices in which each cartridge is equipped with its catalyst.

A variant of this control for a system comprising at least three cartridges, and where the dimensioning of each is determined so that the filtration of the exhaust gases under full load conditions can take place on only two of them, will consist in specializing two of the cartridges for full load operation with one reserved for idling operation and partial loads, in order to maintain the filter medium and the catalyst of the cartridges under full load conditions at high temperature, and to obtain a maximum reduction of all the pollutants. To enable each of them to regenerate under satisfactory conditions, the computer will replace the cartridge used exclusively for idling with one used at full load, as soon as a backpressure level is detected.

The satisfactory operation of the device associated with the catalytic means and of assistances previously described necessarily requires the use of a diesel with a sulfur content limited to 50 ppm, a level that will be generalized from 2005 on.

However, for diesels with sulfur contents higher than 50 ppm, it may be advantageous to use a device like the one shown in FIG. 3, in which the diesel atomizer 11 is used to inject a solution of organometallic additive into the diesel from an additional specific tank containing this mixture.

The temperature gain obtained thanks to the isolation of certain cartridges when the exhaust gas temperatures are too low will serve to obtain satisfactory operation even with the use of such an additive in all situations.

Similarly, this device will be applied to diesel engines of passenger vehicles, with the opening and closing of the valves on each cartridge being controlled directly from the computer controlling these common-rail direct injection engines. This closure can, similarly to the one described previously, be programmed for idling and for low loads. The temperatures reached on this type of engine will make it possible to maintain a sufficiently rapid regeneration reaction virtually permanently on one of the two cartridges, in order to maintain it at an insignificant level of clogging.

The invention claimed is:

1. A method for filtration of exhaust gases, whereby all or part of the particles present in said exhaust gases are retained on filtration means and are burnt by the action of a combustion catalyst, said method comprising obstructing at least a portion of the filtration means as soon as the temperature θg of the exhaust gases to be filtered becomes equal to or lower than a threshold temperature θs, so as to limit cooling of the obstructed portion and to maintain same at a temperature θo that is equal to or greater than θs, up to the time when θg again becomes greater than θs, and thereby to permit accelerated regeneration of this obstructed portion of the filtration means.

2. The method of claim 1, wherein various portions of the filtration means are successively each subjected to the obstruction/regeneration sequence for each variation of θg between a value v1 that is equal to or greater than θs, a value v2 equal to or lower than θs, and again a value v3 equal to or greater than θs, v1=or ≠v3, so as to permit a uniform and continuous regeneration of the filtration means.

3. The method of claim 1, wherein the obstruction of a portion of the filtration means comprises preventing the flow of the exhaust gases by at least 30% of the filtration means, this percentage being expressed as a percentage by volume.

4. The method of claim 3, wherein the flow of exhaust gases is prevented by at least 50% of the filtration means.

5. The method of claim 4, wherein the flow of exhaust gases is prevented by 50 to 75% of the filtration means.

6. The method of claim 1, wherein θs=250° C. or 300° C.

7. The method of claim 1, wherein the exhaust gases are produced by a supercharged diesel engine and in that the datum parameters, that is the temperature θg of the exhaust gases and the threshold temperature θs, are given indirectly by the boost pressure and/or the engine speed and/or the backpressure upstream of the filtration means.

8. The method of claim 7, wherein a threshold boost pressure is equal to 2.5% of a maximum boost pressure of the engine.

9. The method of claim 1, wherein the filtration means comprises at least two filter cartridges, each equipped with an obstructor.

10. The method of claim 9, wherein the filtration means comprises at least three filter cartridges, and wherein two of the three cartridges constitute the obstructed portion of the filtration means when $\theta g \leqq \theta s$.

11. A device for filtration of exhaust gases comprising at least one catalysis means, means for filtration of said exhaust gases, disposed in a reaction chamber in the path of the exhaust gas stream produced by an engine, wherein the filtration means comprises at least two assemblies each comprising a catalyst support adjacent a filter cartridge equipped with a flow obstruction means, further comprising a means for recirculating the exhaust gases at the engine intake, the operation of which is associated with the cutoff of the flow in one or a plurality of the cartridges when the engine is not accelerated, so that the increase in backpressure generated automatically opens a valve that permits recirculation of the exhaust gases.

12. The device of claim 11, wherein each of the filter cartridges has a flow obstruction means, disposed upstream or downstream, controlled by an electronic computer which takes account of all the engine operating conditions, in order to isolate at least one cartridge each time the accelerator position is at zero (not accelerated).

13. The device of claim 11, wherein the filtration means comprises at least three cartridges with a flow obstruction means on each of them, controlled by an electronic computer which takes account of all the engine operating conditions, in order to isolate, in turn, at least two cartridges when the engine is not accelerated, and to isolate the cartridge that filtered the gases in the non-accelerated position, each time the engine is accelerated.

14. The device of claim 11, wherein the flow obstruction means disposed on each filter cartridge comprise a small calibrated orifice to maintain a very low flow rate.

15. The device of claim 11, further comprising a system for post-injection of diesel into the exhaust gases, via an atomizer, upstream of the filtration device and the catalysts, controlled by an electronic computer which takes account of all the engine operating conditions, this diesel post-injection system optionally being associated with an exhaust gas recirculation system.

16. The device of claim 15, wherein the diesel injected contains an organometallic combustion catalyst, supplied or not from a specific tank.

* * * * *